US006077096A

United States Patent [19]

Moring et al.

[11] Patent Number: 6,077,096

[45] Date of Patent: Jun. 20, 2000

[54] WELD STUD

[75] Inventors: Allen Dale Moring, Grosse Pointe Woods; Lawrence John Higgins, Sterling Heights; Mark H. Delcourt, Emmett, all of Mich.

[73] Assignee: Emhart Inc., Newark, Del.

[21] Appl. No.: 09/265,465

[22] Filed: Mar. 10, 1999

[51] Int. Cl.[7] ..... H01R 4/66; H01R 13/648

[52] U.S. Cl. ..... 439/92; 439/801

[58] Field of Search ..... 439/92, 148, 149, 439/521, 801, 883, 884, 84, 387; 219/93, 98, 99, 136; 411/181, 188, 436, 959, 411, 412, 500

[56] References Cited

U.S. PATENT DOCUMENTS

| | | | |
|---|---|---|---|
| 4,411,934 | 10/1983 | Steinhagen . | |
| 4,525,014 | 6/1985 | Holman et al. . | |
| 4,846,611 | 7/1989 | Sadri et al. . | |
| 4,873,763 | 10/1989 | Volonta et al. . | |
| 4,925,353 | 5/1990 | Perugini . | |
| 5,131,855 | 7/1992 | Pickering | 439/92 |
| 5,207,588 | 5/1993 | Ladouceur et al. . | |
| 5,441,417 | 8/1995 | Ladouceur et al. . | |
| 5,487,686 | 1/1996 | Sawada . | |
| 5,644,830 | 7/1997 | Ladouceur et al. . | |

OTHER PUBLICATIONS

PH Stud Drawing XSW0054 (believed to have been offered for sale or publicly used prior to Mar. 10, 1999).

Drawing of weld stud, cap and terminal (believed to have been offered for sale or publicly used prior to Mar. 10, 1999.

Emhart Automotive Drawing of Drawn Arc Stud Welding Sequence (believed to have been offered for sale or publicly used prior to Mar. 10, 1999).

AA Series—Projection Weld Screws (Emhart internet cite: http://135.145.6.182/products/pk/screws.htm) (believed to have been offered for sale, publicly used or published prior to Mar. 10, 1999).

NA Series—Projection Weld Screws (Emhart internet cite: http://135.145.6.182/products/pk/screws4.htm) (believed to have been offered for sale, publicly used or published prior to Mar. 10, 1999).

NN Series—Projection Weld Screws (Emhart internet cite: http://135.146.6.182/products/pk/screws5.htm) (believed to have been offered for sale, publicly used or published prior to Mar. 10, 1999).

UN Series—Projection Weld Screws (Emhart internet cite: http://135.145.6.182/products/pk/screws6.htm) (believed to have been offered for sale, publicly used or published prior to Mar. 10, 1999).

INPR—Plastic Fasteners/Type of Studs (Emhart internet cite: http://135.145.6.182/products/npr/studs.htm) (believed to have been offered for sale, publicly used or published prior to Mar. 10, 1999).

INPR—Plastic Fasteners/Wire Harness Retainers (Emhart internet cite: http://135.145.6.182/products/npr/wire.htm) (believed to have been offered for sale, publicly used or published prior to Mar. 10, 1999).

*Primary Examiner*—Lincoln Donovan
*Assistant Examiner*—Chandrika Prasad
*Attorney, Agent, or Firm*—Harness, Dickey & Pierce, P.L.C.

[57] ABSTRACT

A preferred embodiment of a stud employs a unique thread pattern. A further aspect of the present invention stud includes a body, head and reduced diameter neck configuration. In another aspect of the present invention, the stud is an electrically grounded weld stud. A protective cap is provided for deterring contamination of the threaded portion of a weld stud in still another aspect of the present invention.

32 Claims, 3 Drawing Sheets

WELD STUD

BACKGROUND OF THE INVENTION

The present invention pertains generally to studs and more specifically to a threaded weld stud and a protective cap.

It is well known in the automotive industry to employ a metallic weld stud having an enlarged base and a shaft with a single thread. The traditional thread spirals around the shaft, in a continuous manner, at least fourteen times between the distal end of the shaft and the base. It is common to engage a nut with the threaded shaft so as to retain a component to the stud and vehicle body.

In one traditional application, an electrical eyelet is placed loosely over the shaft of a weld stud. A nut is then rotatably engaged with the threaded stud to secure the terminal. This is used to provide an electrical ground between the electrical terminal and the metal body panel of the vehicle. However, the engagement of this nut and threaded stud is prone to assembly difficulties, especially on a quickly moving vehicle assembly line. For example, nuts are often dropped or incorrectly aligned with the threads during engagement. Furthermore, the torque wrenches employed to drive the nuts are heavy and ungainly to move around in a tightly packaged engine compartment. Moreover, torque of the nut on the stud is often inconsistent leading to possible intermittent electrical connections.

A portion of a weld stud that will contact an electrical terminal must be clean in order to provide a suitable electrical current carrying path. This has proven difficult due to E-coating and subsequent painting of the panel after the stud is welded onto the panel. Thus, plastic protective caps have been placed over the threaded portion of the weld stud during the coating processes in the assembly plant. The protective cap is subsequently removed. However, the conventional caps are provided with an internal thread and an external hexagonal shape in order to allow for secure assembly onto the stud. A torsion wrench is often used to remove these caps from the stud after the painting process. The cap installation and removal process, and tools have also proven difficult to use, time-consuming and cumbersome.

SUMMARY OF THE INVENTION

In accordance with the present invention, a preferred embodiment of a stud employs a unique thread pattern. A further aspect of the present invention stud includes a body, head and reduced diameter neck configuration. In another aspect of the present invention, the stud is an electrically grounded weld stud. A protective cap is provided for deterring contamination of the threaded portion of a weld stud in still another aspect of the present invention. In an additional aspect of the present invention, the cap employs a circular-cylindrical portion, a living hinge portion and a barbed portion. A method of installing a weld stud is also provided.

The weld stud and cap of the present invention are advantageous over conventional devices in that the present invention is ideally suited for accepting longitudinally linear installation and removal of a protective cap and/or a self-attaching electrical terminal. Thus, manual or automated rotation of caps and nuts can be eliminated. This serves to more quickly install and remove members attached to the stud while reducing carpal tunnel syndrome among installers and the carrying of heavy torque wrenches. Furthermore, the unique thread pattern of the present invention stud optimizes the electrical contact between the attached electrical terminal and the body panel attached to the stud, while also allowing for the generally linear installation procedures. The undercut neck and head arrangement of the present invention weld stud also enhances the ability to easily attach and detach the protective cap and/or electrical terminal to the weld stud. The finger, barb and living hinge configuration of the present invention cap also allow for easy manual insertion and removal of the cap to the stud in a generally linear direction. Additional advantages and features of the present invention will become apparent from the following description and appended claims, taken in conjunction with the accompanying drawings.

DETAILED DESCRIPTION OF THE PREFERRED EMBODIMENT

Figure 1:
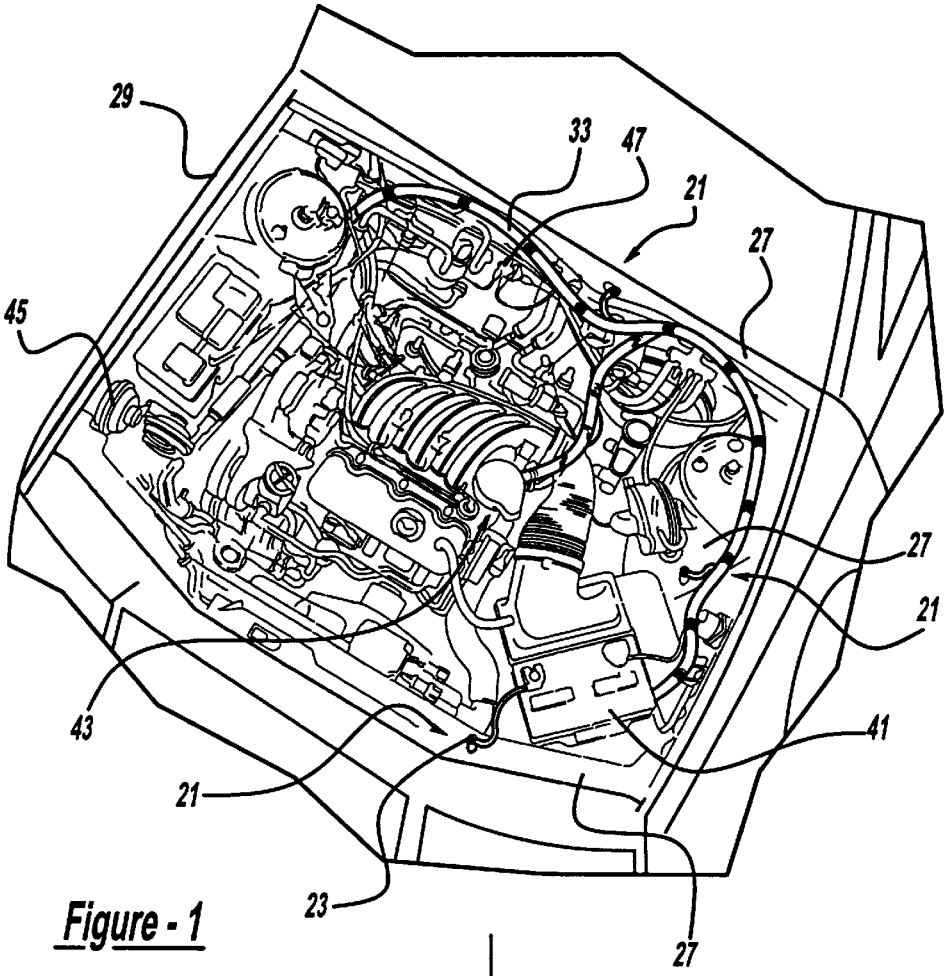
FIG. 1 is a perspective view showing an automotive vehicle engine compartment employing the preferred embodiment of a weld stud of the present invention.
Figure 6:
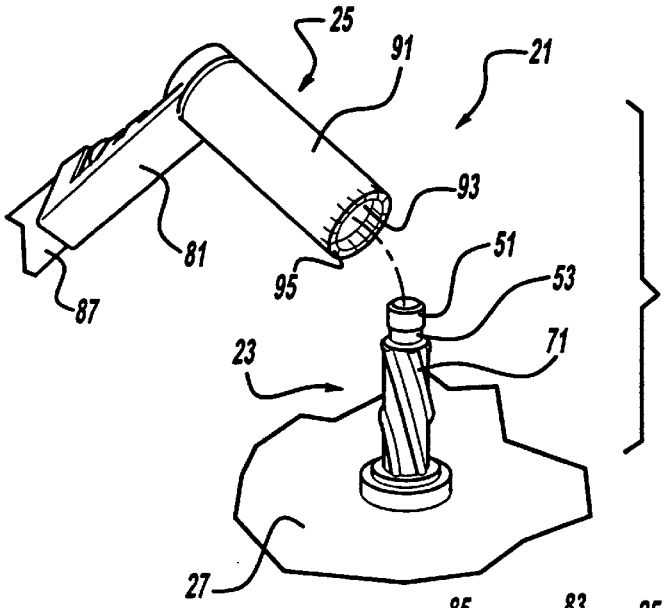
FIG. 6 is an exploded perspective view showing the preferred embodiment weld stud and an electrical terminal.
Figure 7:
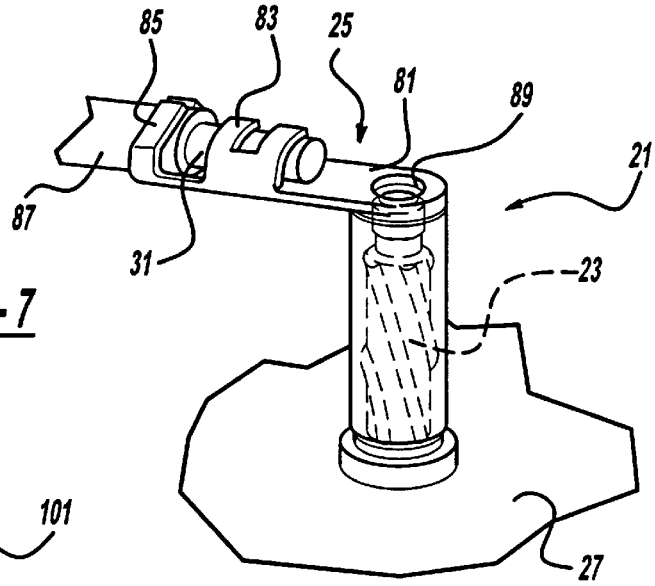
FIG. 7 is an assembled perspective view showing the preferred embodiment weld stud and electrical terminal.

Referring to FIGS. 1, 6 and 7, the preferred embodiment of a weld stud grounding system 21 of the present invention includes a metal weld stud 23 and an electrical terminal 25. Each stud 23 is welded onto a metal body panel 27 of an automotive vehicle 29. Terminal 25 is connected to a wire 31 and is part of an electrical wire harness 33 connected to various electrical components such as a direct current battery 41, fuel rails and valve bodies 43, a horn 45, electric wiper motors 47 and the like.

Figure 2:
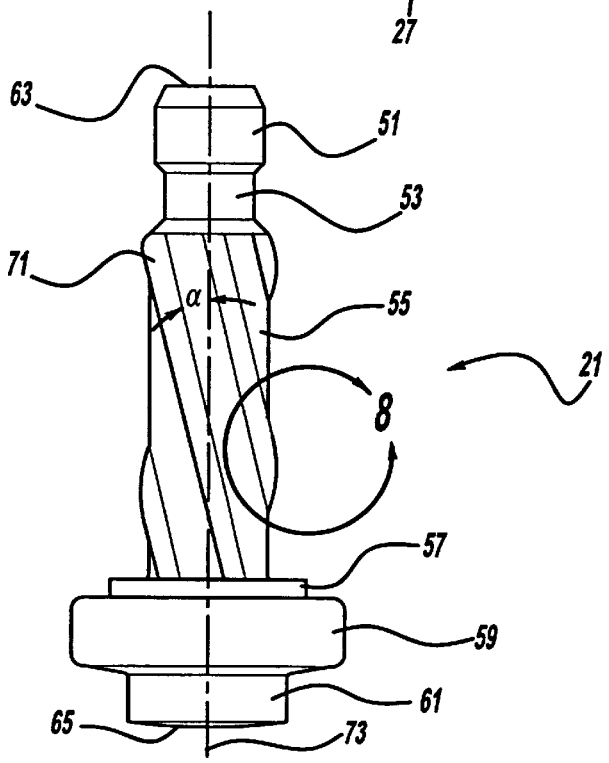
FIG. 2 is a side elevational view showing the preferred embodiment weld stud.
Figure 8:
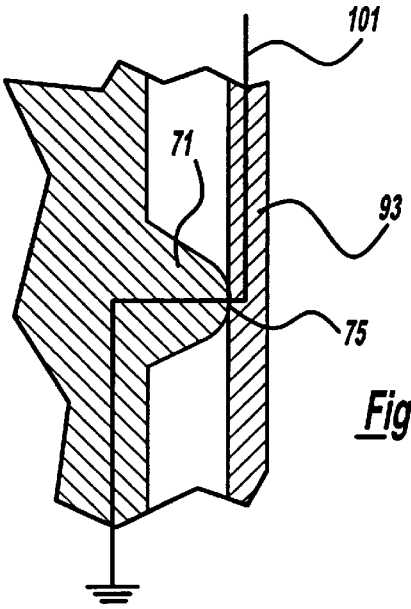
FIG. 8 is an enlarged side elevational view, taken within circle 8 of FIG. 2, showing the preferred embodiment weld stud and electrical terminal.

Weld stud 21, as shown in FIG. 2, includes a head 51, a reduced diameter neck 53, a body 55, a transversely enlarged base 59 and a pedestal 61. Base 59 includes a stepped portion 57. All of the segments 51 through 61 of stud 21 have nominal peripheral surfaces with circular-cylindrical shapes. Chamfers are provided on head 51, adjacent a distal end 63 of stud and adjacent neck 53. A chamfer is provided between neck 53 and body 55, and another chamfer is provided between base 59 and pedestal 61. A slightly rounded surface is located on a proximal end 65 of stud 21 to act as a mating surface with vehicle body panel 27 (see FIG. 7). At least four threads 71 project in a longitudinally elongated fashion from one end of body 55, adjacent neck 53, to the complete opposite end of body 55 adjacent stepped portion 57 of base 59. Threads 71 are laterally spaced apart from each other and gently spiral around base 59 less than 180°. An angle $\alpha$ between the spiraling direction of each thread 71 and a centerline 73 of stud 21 is less than 45°. As shown in FIG. 8, a crest 75 of each thread 71 has a gently rounded configuration. The peripheral surfaces of head 51, neck 53, base 59 and pedestal 61 are all generally smooth and free of threads.

Stud 23 is formed by a cold headed process through which a blank is fed between a punch and die and forcibly compressed three times until the desired shape is formed. The threads are rolled onto the body of stud 23.

The drawn arc stud welding sequence is as follows. Stud 23 is fed into a collet of a weld head or gun (not shown) and the unit is cycled forward until the stud touches panel 27 thereby generating a"stud on work" signal to an electronic control unit. The weld gun subsequently lifts the stud approximately 1.2 millimeters off of the panel. A pilot arc is then generated to ionize an air gap between the proximal end of the stud and the panel. Next, the main welding current is turned on in order to generate molten material at the proximal end of the stud and at the surface of the panel. Finally the weld gun then cycles forward to plunge the stud into the molten puddle of material. The molten weld puddle solidifies and the weld gun retracts, whereby the stud is permanently welded to the panel.

The interface between electrical terminal 25 and weld stud 23 can best be observed in FIGS. 6–8. Electrical terminal 25 has a stamped sheet metal eyelet 81, pairs of opposed bifurcated arms 83 crimped onto conductive wire 31, and another set of arms 85 crimped onto an insulator 87 surrounding wire 31. Eyelet 81 further has an open aperture 89 aligned with stud 23. An annular outer collar 91 is affixed to eyelet 81 and an inner metallic collar 93 is secured to outer collar 91 in a spring-like fashion through a crimped end 95.

Terminal 25 is manually pushed onto stud 23 in a generally linear manner without the need for any tools. Terminal 25 is secured to stud 23 through an interference fit between inner collar 93 and crests 75 of threads 71. Supplemental retention may also be provided by engagement of a portion of terminal 25 with the undercut area defined by head 51 and neck 53 of stud 23. Such supplemental retention can be achieved by way of barbs, compressible washers, gaskets or the like inwardly extending within the collars. Thus, the specific configuration of stud 21 allows for linear installation of terminal 25 and self-retention of terminal 25 to stud 23 without the need for extraneous nuts, screws or other rotatable fasteners. An electrical grounding path 101 is thereby provided between electrical terminal 25 and stud 23, primarily through the spaced apart and non-contiguous threads 71. It may also be desirable to use a protective rubber or plastic cap to cover the assembled terminal to prevent inadvertent electrical grounding with adjacent wires and electrical componentry.

Figure 3:
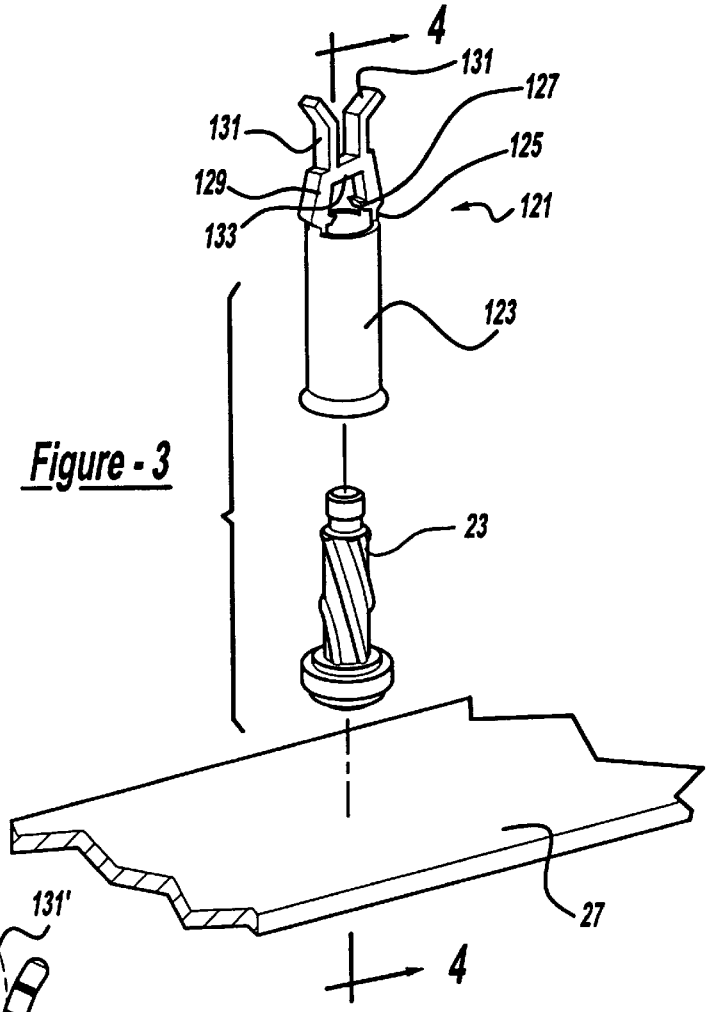
FIG. 3 is an exploded perspective view showing the preferred embodiment weld stud, cap and automotive vehicle panel.
Figure 4:
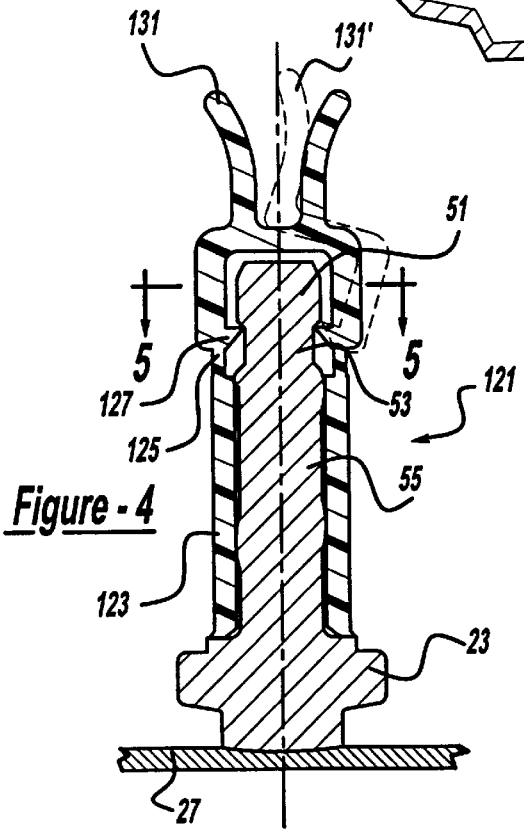
FIG. 4 is a cross sectional view, taken along line 4—4 of FIG. 3, showing the preferred embodiment weld stud, cap and panel.
Figure 5:
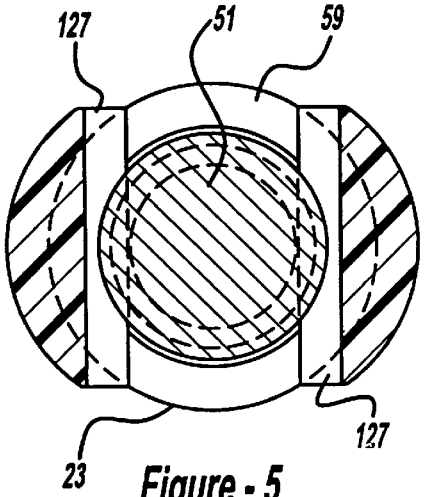
FIG. 5 is a cross sectional view, taken along line 5–5 of FIG. 4, showing the preferred embodiment weld stud and cap.

FIGS. 3–5 illustrate an injection molded nylon cap 121 which is temporarily applied onto weld stud 23. Cap 121 has a circular-cylindrical portion 123, a pair of living hinges 125, a pair of barbs 127 and a head portion 129. A pair of longitudinally extending fingers 131 project from a transverse wall 133 of head portion 129. Cylindrical portion 123 completely surrounds body 55 of stud 23. Meanwhile, barbs 127 engage the undercut area defined by head 51 and neck 53 of stud 23. Circumferential lateral openings are provided between barbs 127.

Cap 121 is linearly installed in a longitudinal direction over stud 23 in a manual manner, after stud 23 has been welded to panel 27. Cylindrical portion 123 of cap 121 protectively covers threads 71 from E-coating and painting of the adjacent panel 27. However, such coatings are allowed access to head 51 of stud 23. It is important to minimize contamination of threads 71 in order to maintain a proper electrical path when later attached to the electrical terminal. Cap 121 is linearly removed from stud 23 by hand after the coating processes. This is easily done by compressing fingers 131 toward each other; this causes flexure of head portion 129 of cap 121 and at least partially disengages barbs 127 from head 51 of stud 23. Cap 121 is subsequently pulled off of stud 23 in a linear manner without significant rotation. Thereafter, the electrical terminal can be installed.

While the preferred embodiment weld stud, protective cap and electrical grounding system have been disclosed, it will be appreciated that various other embodiments may form part of the present invention. For example, a variety of electrical terminals, having alternate configurations and shapes, may be attached to the stud of the present invention. Furthermore, it may be possible to employ the present invention thread pattern without the need for the presently described head and neck configuration, and vice versa, if a different type of protective cap and/or electrical terminal are attached. Moreover, other barb and finger arrangements may be used with the present invention cap. It is further envisioned that the weld stud, cap and grounding system of the present invention can be employed for home appliances, industrial electric devices and other non-automotive situations. Various materials, shapes and sizes have been disclosed, however, other materials, shapes and sizes may be readily substituted. It is intended by the following claims to cover these and any other departures from the disclosed embodiments which fall within the true spirit of this invention.

The invention claimed is:

1. An electrically grounding stud comprising:

a circular-cylindrical body elongated in a longitudinal direction;

spiral threads projecting from the body, each of the threads being separated and laterally spaced apart from each other and each of the threads spiraling around the body less than 360°.

2. The stud of claim 1 further comprising a base having a transverse dimension larger than a diameter of the body.

3. The stud of claim 2 further comprising an annular welding pedestal projecting from the base opposite the body, the pedestal being coaxially aligned with the base and body, the pedestal having a transverse dimension smaller than the transverse dimension of the base and larger than the diameter of the body.

4. The stud of claim 1 further comprising:

a head coaxially aligned with the body; and a neck joining the head to the body, the neck having a circular periphery with a diameter less than diameters of the head and body.

5. The stud of claim 4 wherein a peripheral surface of the head is substantially smooth and free of threads.

6. The stud of claim 1 wherein each of the threads has a rounded crest.

7. The stud of claim 1 wherein each of the threads spiral around the body less than 180°.

8. The stud of claim 1 wherein the body is metal.

9. A weld stud comprising:

a cylindrical body elongated in a longitudinal direction and having a first peripheral dimension;

at least three separate threads longitudinally extending from substantially one end of the body to the opposite end of the body in a substantially parallel spiraling manner, each of the threads being spaced apart from each other and each of the threads spiraling around the body less than 360°;

a base having a peripheral second dimension larger than the first dimension;

a welding pedestal projecting from the base opposite the body, the pedestal being substantially coaxially aligned with the base, the pedestal having a third peripheral dimension smaller than the second dimension;

a head coaxially aligned with the body and having a fourth peripheral dimension; and a neck joining the head to the body, the neck having a fifth peripheral dimension less than the first and fourth dimensions.

10. The stud of claim 9 wherein each of the threads has a rounded crest.

11. The stud of claim 9 wherein each of the threads spiral around the body less than 180°.

12. The stud of claim 9 wherein a peripheral surface of the head is substantially smooth and free of threads.

13. An automotive vehicle electrical grounding system comprising:

a metal body panel of the vehicle;

a metal stud having a first segment attached to the panel, a second segment longitudinally extending from the first segment and a third segment longitudinally extending from the second segment opposite the first segment;

the second segment being transversely larger than either the first and third segments;

the third segment being longitudinally elongated larger than either the first and second segments;

the stud further having a neck longitudinally extending from the third segment and a head longitudinally extending from the neck opposite the third segment, the head having a transverse dimension smaller than the second segment and the neck having a transverse dimension smaller than either the head and the third segment;

a plurality of spaced apart threads projecting from the third segment and each of the threads substantially extending in a longitudinally spiraling manner from adjacent the neck to adjacent the second segment; and an electrically conductive path provided between the third segment of the stud and the panel.

14. The system of claim 13 further comprising a member having a fastening portion disengagably secured to the stud adjacent the neck.

15. The system of claim 14 wherein the member peripherally surrounds at least a portion of the stud.

16. The system of claim 14 wherein the member has a cylindrical portion that surrounds a longitudinal majority of the third segment of the stud.

17. The system of claim 13 further comprising a flexible member deterring contamination of a portion of the stud, the member being removable from the stud.

18. The system of claim 17 wherein the member is plastic.

19. The system of claim 13 further comprising at least one thread projecting from the third segment.

20. The system of claim 13 wherein the first segment of the stud is welded to the panel thereby creating a permanent electrically conductive path between the head of the stud and the panel.

21. A weld stud cap comprising:

a longitudinally elongated cylindrical portion;

an inwardly barbed portion;

a living hinge portion flexibly connecting the cylindrical portion to the barbed portion;

a head portion attached to the barbed portion substantially opposite the living hinge portion, the head portion including a transversely oriented wall; and at least one elongated finger projecting from the head portion.

22. The cap of claim 21 wherein the at least one finger includes a pair of fingers longitudinally projecting from the transversely oriented wall.

23. The cap of claim 22 wherein compression of the fingers toward each other aids in flexing the barbed portion away from a longitudinal centerline of the cylindrical portion.

24. The cap of claim 21 wherein the barbed portion includes two inwardly extending barbs joined only by the head and the cylindrical portion, openings being located between the barbs.

25. The cap of claim 21 wherein the portions are plastic and an internal surface of the cylindrical portion is smooth.

26. A method of assembling a weld stud to an automotive vehicle panel to create an electrically grounded path between the stud and the panel, the stud having threads and the cap having barbs, the method comprising:

(a) forming multiple spaced apart, spiral threads on the stud;

(b) welding the stud to the panel;

(c) pushing a protective cap over a threaded segment of the stud to deter a coating from contaminating the threads;

(d) flexing the cap to at least partially disengage barbs of the cap with an undercut of the stud; and (e) substantially linearly pulling the cap off of the stud to expose the threads of the stud for a subsequent electrical connection.

27. The method of claim 26 further comprising forming threads on a circular-cylindrical shaft of the stud such that the threads do not spiral around the shaft more than about 180°.

28. The method of claim 26 further comprising allowing the panel coating to adhere to a head of the stud longitudinally located on end of the stud opposite the panel.

29. The method of claim 26 further comprising providing electrical current initially to the threads of the stud prior to transmission of the electrical current to a transversely elongated base of the stud.

30. The method of claim 26 further comprising removing the cap from the stud in a manual and tool-free manner.

31. The stud of claim 1 further comprising a welding surface located adjacent an end of the body, wherein the stud is an automotive vehicle weld stud.

32. The stud of claim 9 wherein an end of the head is substantially flat and the body is free of insulation if conducting electricity.

* * * * *